United States Patent [19]

Rinehart

[11] 4,123,803

[45] Nov. 7, 1978

[54] THUMB CONSTRUCTION FOR A GLOVE

[75] Inventor: Dixie L. Rinehart, Aspen, Colo.

[73] Assignee: Wells-Lamont Corporation, Chicago, Ill.

[21] Appl. No.: 852,471

[22] Filed: Nov. 17, 1977

[51] Int. Cl.[2] ..... A41D 19/00

[52] U.S. Cl. ..... 2/163

[58] Field of Search ..... 2/159, 163, 169; 66/174

[56] References Cited

U.S. PATENT DOCUMENTS

| | | | |
|---|---|---|---|
| 626,353 | 6/1899 | Vogan | 2/163 |
| 772,044 | 10/1904 | Lindner | 2/163 X |
| 2,779,178 | 1/1957 | Bialostok | 66/174 |

FOREIGN PATENT DOCUMENTS

| | | | |
|---|---|---|---|
| 692,337 | 7/1930 | France | 2/159 |

*Primary Examiner*—Dorsey Newton

*Attorney, Agent, or Firm*—Pennie & Edmonds

[57] ABSTRACT

A glove having a back piece, a palm piece and a thumb construction where the palm piece has a substantially straight slit therein to form a button-hole like opening. The thumb construction is formed of two similarly shaped panels which are joined together and which extend through the slit with the bottom part of the thumb construction being jointed at the edges of the slit to the inwardly facing side of the palm piece.

6 Claims, 9 Drawing Figures

THUMB CONSTRUCTION FOR A GLOVE

BACKGROUND OF THE INVENTION

Many forms of glove constructions have existed over the years which give a comfortable fit to the hands. Such constructions that have existed have required highly skilled labor to shape and assemble the various parts making up the glove in order to assure that the glove would have an accurate, comfortable fit when worn. These prior art constructions involve use of parts having complicated uneven patterns to make thumb constructions which in turn require complex stitching to join the parts together. Further the manufacturing and assembly process of prior glove constructions was complicated by the fact that thumb constructions for the same pair of gloves were not interchangeable, that is a thumb construction of a right-hand glove could not be used with a left-hand glove.

An example of a prior art glove construction is the "Key-hole" thumb construction in which the palm piece of a glove has a key-hole shaped cutout in the general shape of a kidney bean to which base portions of a thumb construction are joined by stitching. The sewing control required to obtain the proper stitching is difficult to maintain due to the complex shape of the cutout. Further the thumb constructions of such gloves are not interchangeable.

Another prior art glove construction is the "Wing-thumb" or continuous thumb construction wherein the palm piece has a part of the thumb construction integral therewith. This construction, in addition to a back piece, requires a separate side panel which forms a back part of the thumb construction and which must be joined by stitching to both the back and palm pieces. This construction, like the key-hole construction, lacks interchangeability of the thumb construction.

A further glove construction is the "English-Thumb" construction and, like the key-hole construction, involves a palm piece having a complex shaped cutout to which must be joined a thumb portion made from a pattern having a complex shape which has to be precisely cut to conform to the edges of the cutout portion. The resulting stitch pattern necessary to join the thumb construction to the palm piece is difficult to control and interchangeability of the thumb construction is lacking.

A still further glove construction is the "Gunn-Thumb" construction. This glove like the aforementioned wing-thumb construction involves the use of complexed shaped patterns where the inwardly facing side of the thumb portion is integral with the palm piece and where the outwardly facing side of the thumb portion comprises a separate panel which must be joined with both the palm and back pieces. Interchangeability of the thumb construction is lacking.

It is therefore an object of my invention to provide for a glove which requires a minimal use of complex shaped patterns, where the thumb construction may be easily assembled, where there may be interchangeability of thumb constructions between right and left-hand gloves, where the stitching required to join the thumb construction to the palm piece is kept to a minimum and where such stitching as is required may be done "in-the-flat."

GENERAL DESCRIPTION OF THE INVENTION

Generally my invention comprises making a glove from essentially three parts, namely a palm piece, a back piece and a thumb construction. The palm piece has a substantially straight slit cut therein through which the thumb construction extends. The thumb construction comprises two similarly shaped elongated panels which are united on one side and where each panel has an enlarged base portion, a rounded end opposite the base portion and a straight side opposite the united side. The straight sides and rounded ends of two panels are stitched together to form a thumb construction which is then inserted through the slit with the base portions of the two panels being joined to the inner facing surface of the palm piece adjacent the edges of the slit. The elongated panels are formed such that the longitudinal axis of the panels are inclined with respect to the edges of the slit and such that the thumb portion when assembled to the palm piece will conform to the thumb of the wearer.

Preferably the two panels making up the thumb portion coincide with one another facilitating their being joined together by stitching. Alternatively the two panels may be cut from a single piece to form a butterfly shaped construction wherein the panels are united along a line opposite their straight sides. The two panels are then folded on the line and their rounded ends and straight sides are stitched together. Thumb constructions made from these panels are interchangeable between right and left-hand gloves.

The thumb construction may be joined to the edges of the slit by a variety of stitches. For example the base portion of the thumb construction may be joined directly to the inner facing surface of the palm piece adjacent the edges of a slit by conventional stitching, or the edges of the slit may be folded over to form a lap seam which is then joined by stitching to the base portions of the panels.

DESCRIPTION OF THE PREFERRED EMBODIMENTS

Figure 1:
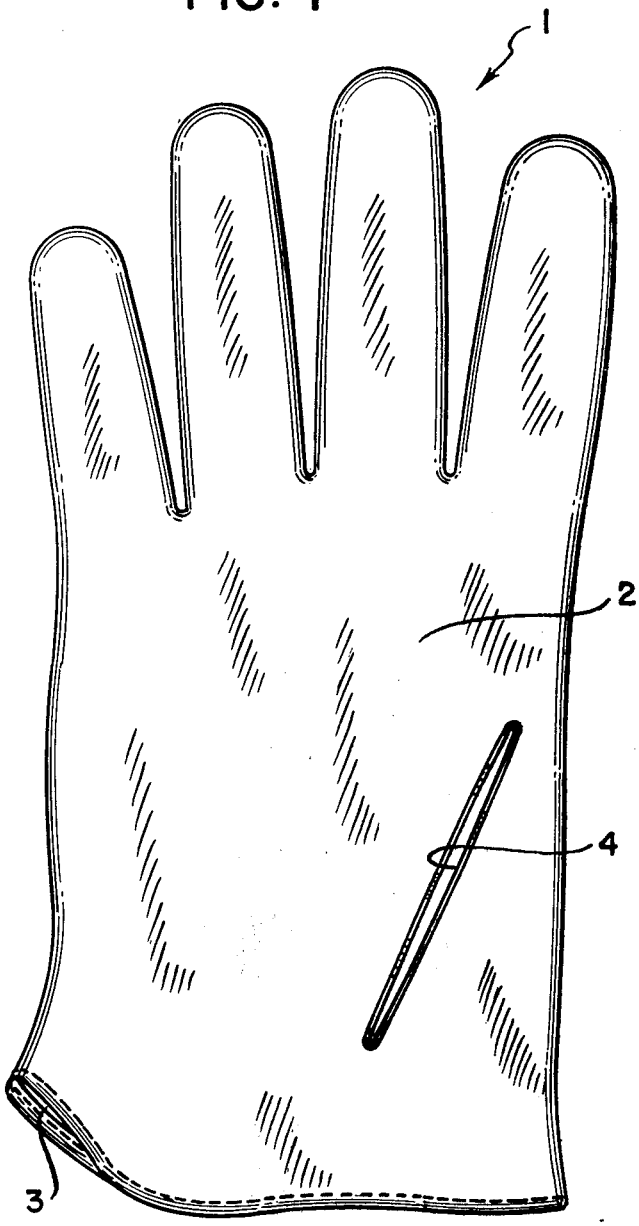
FIG. 1 is a plan view of a palm piece of a glove constructed according to the invention, in this case a right-hand glove, joined to and overlying a back piece.

Referring to FIG. 1 there is illustrated a glove 1 having a palm piece 2 joined to a back piece 3. As shown the palm piece 2 has a slit 4 cut therein having substantially straight sides and through which a thumb construction is adapted to extend.

Figure 2:
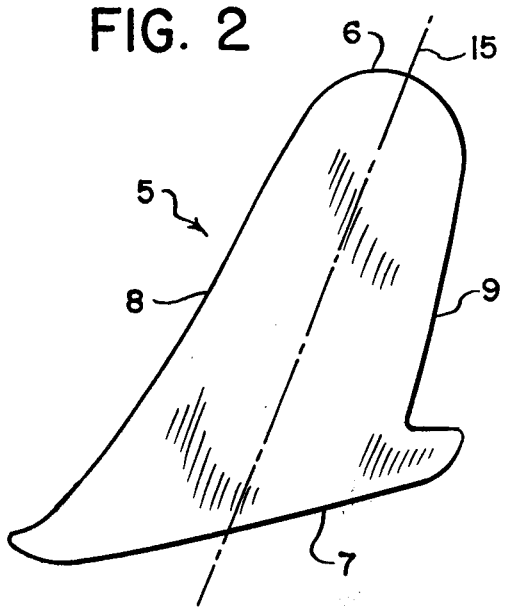
FIG. 2 is a plan view of one panel forming a part of a thumb construction.
Figure 3:
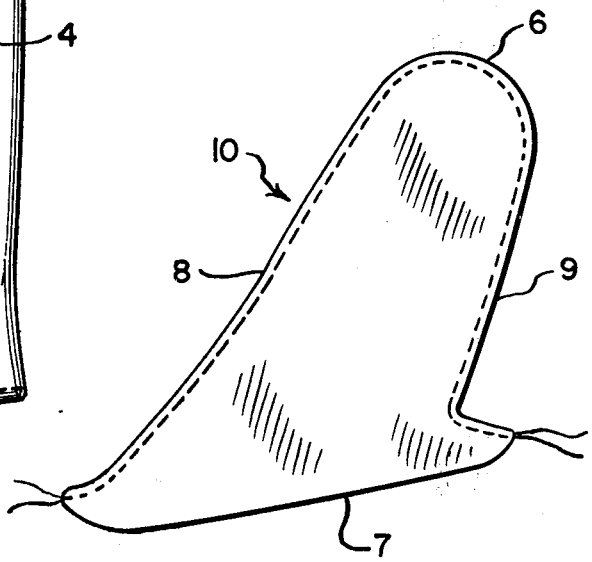
FIG. 3 is a view of the panel of FIG. 2 joined to and coinciding with a second identical panel to form a thumb construction.

Referring to FIG. 2 there is illustrated a panel 5 having a rounded end 6, an enlarged base portion 7 and a first straight side 8 as well as a second straight side 9. As shown in FIG. 3 the panel 5 is joined with an identically shaped panel by stitching along the straight edges 8 and 9 and rounded end 6 to form a thumb construction 10. If desired the thumb construction may then be turned inside out so that the outer edges of the thumb construction will have an inseam construction.

Figure 7:
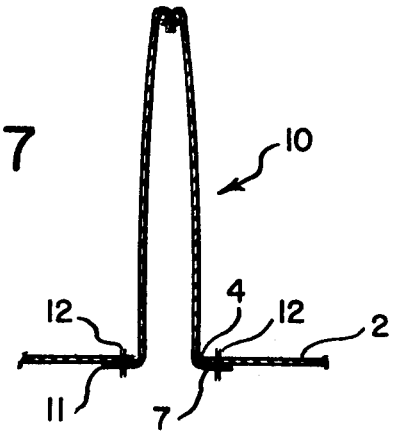
FIG. 7 is a cross-sectional view of FIG. 6 taken along lines 7—7 illustrating a lap seam connection and a stitch pattern for connecting the thumb construction with the palm piece.
Figure 6:
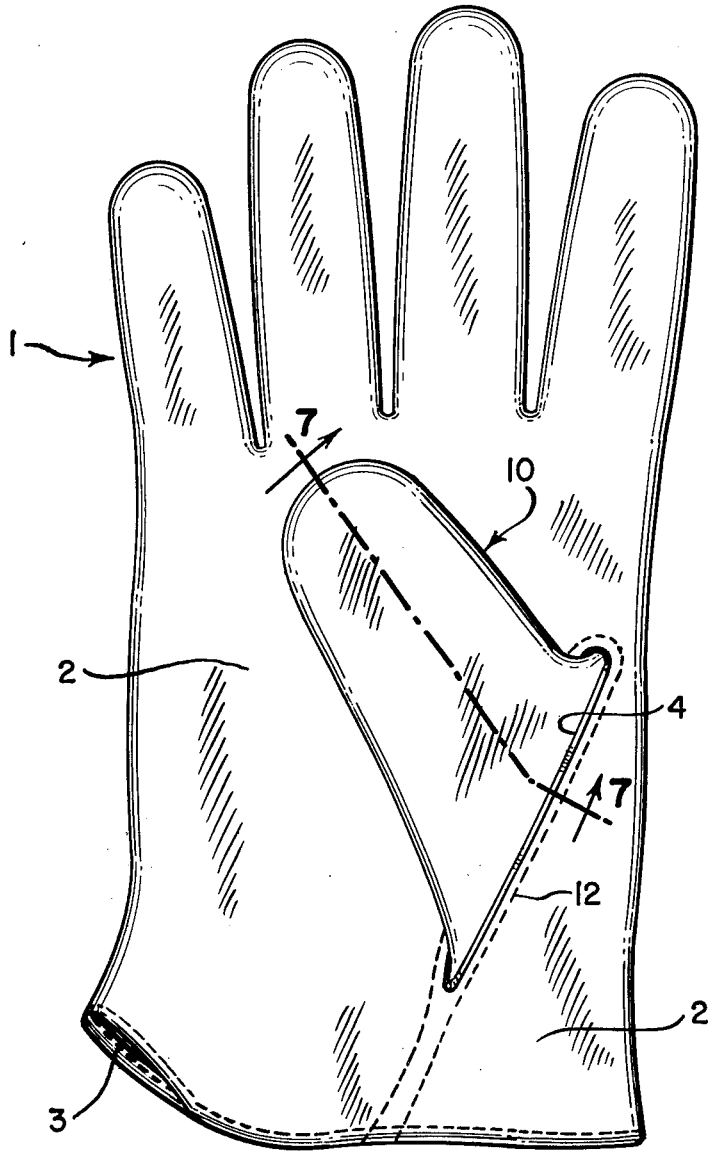
FIG. 6 is a view similar to FIG. 1 illustrating a completed glove where the thumb construction is made from the panels of either FIG. 2 or FIG. 4.

The thumb construction 10 is then inserted through the slit 4 as shown in FIGS. 6 and 7 after which the base 7 of each panel is folded so as to form a lap seam with the inner facing surface 11 of the palm piece. The base 7 and the palm piece 2 are joined by conventional stitching 12.

The elongated panels 5 each have a longitudinal axis 15 which is inclined with respect to the base 7. The result is that when the thumb construction 10 made up of the panels is joined to the palm piece 2, the thumb construction will be inclined with respect to the slit 4 as shown in FIG. 6 whereby the thumb portion will fit the thumb of the glove wearer. The palm piece 2 and the glove of FIG. 6 are for the right hand.

It is apparent that the thumb construction 10 shown in FIG. 3 could be used with a left-hand glove merely by turning the thumb construction over. The left-hand glove would have the slit 4 in a palm piece extending in approximately an 11 o'clock position rather than the 1 o'clock position as shown in FIG. 1 or approximately 30° with respect to the longitudinal axis of the palm portion. Interchangeability of the thumb construction facilitates easy assembly of parts making up the glove and reduces expense in that the same parts may be used for both right and left-hand gloves and wherein the parts making up the thumb construction may be cut using the same pattern for both the back and front panels covering the thumb.

Further the construction as shown in FIG. 6 allows sewing of the parts "in-the-flat" while at the same time minimizing the number of seams required. This results in a glove having less bulk in the palm area and reduction of seam stress resulting from movement of the hand and thumb.

Figure 4:
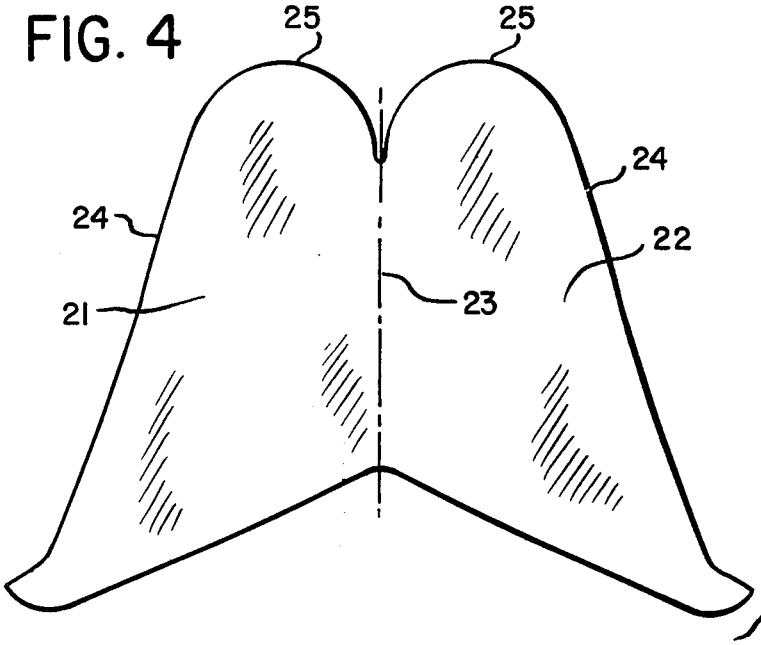
FIG. 4 is a plan view of a modified form of panels illustrating the panels united together.
Figure 5:
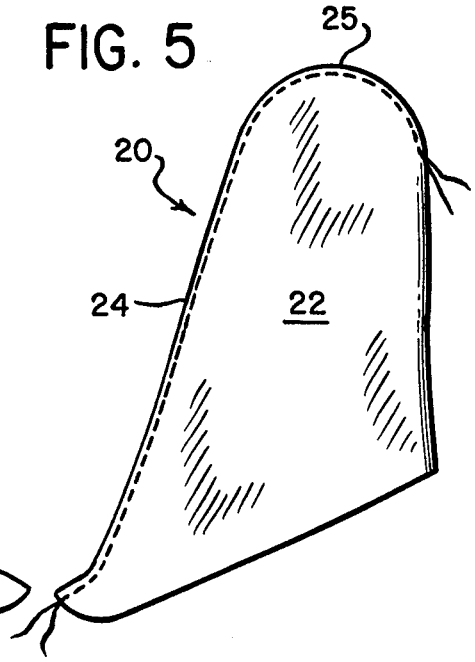
FIG. 5 is a view of the panels of FIG. 4 folded to form a thumb construction.

Referring to FIG. 4 a modified form of a thumb construction 20 is shown in which panels 21 and 22 are united and integral with each other along a line 23 which is opposite the straight side 24 of each panel. To form a thumb construction, the panels are folded along the line 23 and the rounded ends 25 as well as the straight sides 24 are sewn together as shown in FIG. 5. The thumb construction 20 is then assembled into a palm piece in the same manner as the thumb construction 10 of FIG. 3.

Figure 8:
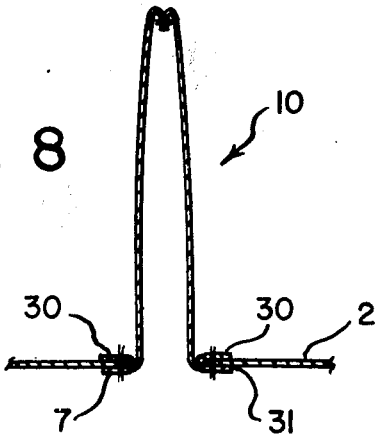
FIG. 8 is a view similar to FIG. 7 illustrating a lap seam with a slit edge fold connecting the thumb construction and the palm piece.

If desired a portion 30 of the edges of the slit 4 may be turned back as shown in FIG. 8 to form a slit edge fold. This fold is then sewn to the base portion 7 in the same manner as shown in FIG. 7.

Figure 9:
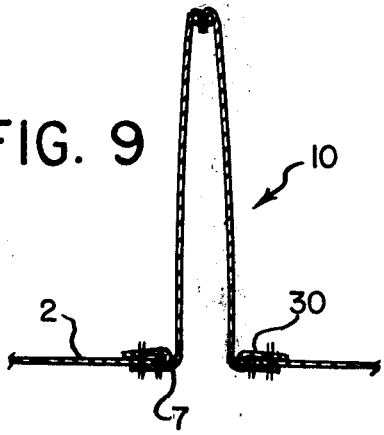
FIG. 9 is a view similar to FIG. 8 illustrating a modified stitch pattern.

If desired a second stitch line may be included as shown in FIG. 9 wherein the assembly is slightly different than that in FIG. 8. In FIG. 9, the base 7 would be initially stitched to the palm piece 2 to form a lap seam prior to the portion 30 being turned back to form the slit edge fold 31. After the initial stitching, the portion 30 would be folded over and the second stitch line completed as in FIG. 8.

Preferably the thumb construction is joined to the palm piece prior to the back piece being joined to the palm piece in order to facilitate assembly. It is clear however that in some instances it may be desirable to insert and join the thumb construction to the palm piece after the palm piece has been joined to the back piece.

A glove constructed according to my invention is applicable for use with sporting gloves, dress gloves or work gloves, it being apparent that the particular thumb construction combined with the substantially straight slit in the palm piece is adaptable for use with many different kinds of gloves.

I claim:

1. A glove having a back piece, a palm piece and a thumb construction, the improvement comprising in that said palm piece has a substantially straight slit having parallel sides cut therein extending approximately 30° with respect to the longitudinal axis of the palm piece; in that said thumb construction comprises two similarly shaped elongated panels each having a longitudinal axis, a rounded end, a straight side joining the rounded end and an enlarged base portion adjacent said straight side and opposite said rounded end with said panels being united together along a line opposite their straight sides; in that said panels are joined together along their straight sides and along their rounded ends; and in that said enlarged bases are joined to the edges of said slit with the longitudinal axes of said panels being inclined with respect to said slit.

2. A glove according to claim 1, the improvement further comprising in that said panels are integral with each other.

3. A glove according to claim 1, the improvement further comprising in that said panels are united together by stitching.

4. A glove according to claim 1, the improvement further comprising in that said thumb construction extends through said slit with the base portions being connected to an inner side of said palm piece by stitching to form a lap seam.

5. A glove according to claim 4, the improvement further comprising in that the edges of said slit are folded outwardly of the palm piece to form an edge fold; and in that the edge fold is connected by stitching to the base portions.

6. A glove according to claim 1, the improvement further comprising in that said panels coincide with one another.

* * * * *